US005186048A

United States Patent [19]

Foster et al.

[11] Patent Number: 5,186,048

[45] Date of Patent: Feb. 16, 1993

[54] METHOD AND APPARATUS FOR LOGGING A WELL BELOW A DOWNHOLE PUMP

[75] Inventors: Brian Foster, Fife, Scotland; John Blair, Joo Chiat Terrace, Singapore

[73] Assignee: Schlumberger Technology Corporation, Houston, Tex.

[21] Appl. No.: 582,634

[22] Filed: Sep. 13, 1990

[30] Foreign Application Priority Data

Sep. 14, 1989 [EP] European Pat. Off. ..... 89402510.5

[51] Int. Cl.[5] ..... E21B 23/08

[52] U.S. Cl. ..... 73/155; 166/250

[58] Field of Search ..... 73/151, 155; 166/250

[56] References Cited

U.S. PATENT DOCUMENTS

| | | | |
|---|---|---|---|
| Re. 32,336 | 1/1987 | Escaron et al. | 166/250 |
| 2,943,682 | 7/1960 | Ingram et al. | 166/77 |
| 4,098,342 | 7/1978 | Robinson et al. | 166/250 |
| 4,267,726 | 5/1981 | Noik | 73/151 |
| 4,488,597 | 12/1984 | Hoppe et al. | 166/250 |
| 4,664,189 | 5/1987 | Wittrisch | 166/250 |
| 4,690,214 | 9/1987 | Wittrisch | 166/250 |

FOREIGN PATENT DOCUMENTS

| | | | |
|---|---|---|---|
| 2519689 | 7/1983 | France . | |
| 2614934 | 11/1988 | France . | |
| 1151661 | 4/1985 | U.S.S.R. | 166/250 |
| 2135719 | 9/1984 | United Kingdom . | |
| 9000667 | 1/1990 | World Int. Prop. O. . | |

*Primary Examiner*—Hezron E. Williams
*Assistant Examiner*—Craig Miller
*Attorney, Agent, or Firm*—Henry N. Garrana; John H. Bouchard

[57] ABSTRACT

Method and apparatus for logging a formation interval in a well when the fluids are produced therefrom by a downhole pump. The method comprises lowering into the well a tubing (10) carrying a downhole pump (14) and a logging assembly, the logging assembly comprising a support (31) releasably latched in the tubing at an upper position located a predetermined distance above the pump, a cable section (26) attached to the support and passing from the bore of the tubing to the well bore along the pump through a sealed passage (25), and a well logging tool (15) attached at the lower portion of the cable section in a protecting sleeve (28). When the pump is at the correct depth in the well, a cable is passed from the surface through the tubing and connected to the support (31) by means of a wet connector. The support is released from its upper latching position and lowered in the tubing for bringing the logging tool (15) to the formation interval (12). Then, the formation interval can be logged while fluids are pumped out from the interval by the downhole pump.

17 Claims, 4 Drawing Sheets

METHOD AND APPARATUS FOR LOGGING A WELL BELOW A DOWNHOLE PUMP

BACKGROUND OF THE INVENTION

The invention relates generally to a method and apparatus for evaluating the fluids produced from a formation interval in a well and more particularly to such method and apparatus to be used when the fluids are pumped from the formation interval by a downhole pump.

Production logging tools for evaluating the fluid produced from a formation interval are well known. These logging tools are designed to measure several characteristics of the fluids such as the velocity, the density, the temperature and the pressure of the fluids. Standard logging tools are designed to be lowered into the well through a tubing to derive measurements from a production zone below the tubing. In order to evaluate a production interval, several passages of a combined production logging tool are carried out along the formation interval as described for example in U.S. Pat. No. 4,267,726 (Noik).

Most of the time, wells can be produced by replacing the drilling mud by a lighter fluid such as oil. The downhole well pressure is thus reduced and fluids start flowing naturally from the producing formation interval through the tubing due to the existing formation pressure. The fluids produced can be evaluated by a production logging tool lowered to the formation interval through the bottom end of the tubing which has an opening large enough for the logging tools to be moved therethrough.

However, in some circumstances, the fluids have to be pumped from the formation interval by a pump connected at the lower end of the tubing string. Known electrical submersible pumps can be used which are fed with electrical current through a cable extending along the tubing to the surface. Since the pump is at the bottom end of the tubing, the logging tools have to be lowered into the well in the annulus outside the tubing. Usual electrical pumps have a relatively important outside diameter of around 5.5 inches (14 cm). When such a pump is used in a 7 inch casing with an inside diameter of about 6.3 inches (16 cm), the clearance between the pump and the casing is less than one inch (2.5 cm) and a standard production logging tool which has a usual outside diameter of 1 11/16 inch (4.3 cm) cannot be lowered below the pump through this space. Then, a special small diameter logging tool has to be designed.

One object of the invention is to provide a method and an apparatus which allow production logging measurements to be carried out by standard logging tools in a formation interval located below a downhole pump when fluids are pumped out of the formation interval.

Another object of the invention provides a method and apparatus for evaluating the fluids produced in a well by pumping wherein a production logging tool can be run below a downhole pump in relatively small diameter wells.

SUMMARY OF THE INVENTION

These and other objects are attained, according to a first aspect of the invention by a method for evaluating fluids produced by pumping from a formation interval in a well, comprising the steps of: lowering into the well a tubing carrying a downhole pump and a logging assembly, said logging assembly comprising a support slidably mounted in the tubing between an upper and a lower position above the pump, a cable section attached to the support and passing from the bore of the tubing to the well bore along the pump through a substantially sealed passage, and a well logging tool attached to the lower portion of the cable section; passing an electric cable from the surface through the tubing; connecting the cable to the support; and lowering the support and the logging assembly for bringing the logging tool to the formation interval to evaluate the fluids being produced from the formation interval by the downhole pump.

Preferably, protecting means are attached to the pump for receiving the logging tool. Before lowering the pump and the logging assembly into the well, the support is latched at the upper position in the tubing, and, after connecting the cable to the support, the cable is manipulated to release the support from the upper position.

After evaluating the fluids produced, the method further comprises the steps of: deconnecting the cable from the support; pulling the electric cable out of the tubing; and withdrawing the pump and the logging assembly from the well by means of the tubing. The support can be parked in the upper position with the logging tool in the protecting means thereby allowing the production to be maintained until a later convenient time is reached to pull out the tubing.

Preferably, before deconnecting the cable from the support, the support is latched in the tubing at the lower position.

According to another aspect of the invention, an apparatus for evaluating the fluids produced by pumping from a formation interval in a well, comprises: a pump connected to a tubing adapted to be suspended in the well; a mounting block located above the pump and having a passage communicating the bore of the tubing with the well bore along the pump; a support slidably mounted in the tubing between an upper and a lower position above the mounting block; a cable section attached to the support and passing from the bore of the tubing through the passage to the well bore along the pump; a well logging tool attached to the cable section below the pump; sealing means in the second passage for substantially preventing fluid flow through the passage around said cable section; and first connecting means on the support engageable by second connecting means at the end of a cable extending to the surface for mechanically and electrically connecting the cable to the support to move the logging tool to the formation interval to evaluate the fluids produced from the formation interval by the downhole pump.

Preferably, the apparatus comprises upper latching means for releasably maintaining the support in the upper position when the apparatus is lowered into the well and lower latching means for maintaining the support in the lower position when the apparatus is pulled out of the well.

The apparatus further comprises protecting means attached below said pump for receiving the well logging tool when the support is in the upper position.

BRIEF DESCRIPTION OF THE DRAWINGS

Other features and advantages of the invention will become more clearly apparent in connection with the following detailed description of a preferred embodiment, taken in conjunction with the attached drawings in which.

DETAILED DESCRIPTION

Figure 1:
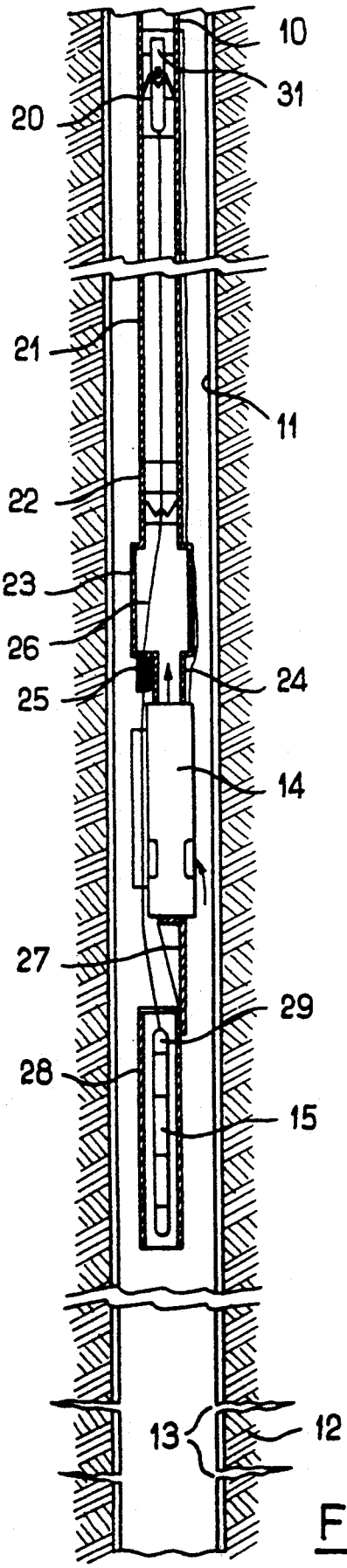
FIG. 1 is a schematic view of an apparatus according to the invention, the apparatus being shown in a well.

Referring initially to FIG. 1, there is shown schematically a string of tubing 10 disposed in a cased well 11 which extends down from the surface of the ground to an interval of earth formations 12 which is to be tested. The casing has perforations 13 in front of the formation interval 12 so that fluids contained in this interval can be produced therethrough for the test. However the formation interval has a low internal fluid pressure and the production fluids have to be pumped out to the surface by a downhole pump 14 located in the well a relatively short distance, for example a few hundred feet, above the formations interval. The downhole pump 14 is connected at the lower end of the string to pump the produced fluids through the tubing to the surface of the earth.

The present invention is arranged in such a manner that characteristics of the fluids flowing from the formation interval can be measured by a well logging tool 15 below the pump 14. To evaluate the formation interval, several passes of the well logging tool 15 are to be run along the formation interval 12 to measure characteristics of the flowing fluids as a function of depth.

The lower end of the tubing 10 is connected to an upper latching section 20 which is threaded to an intermediate tubing section 21 including a number of standard tubing lengths connected to one another. The number of tubing lengths is determined by the length of the interval to be tested.

At the lower end of the intermediate tubing section 21, is threaded a lower latching section 22 the lower part of which is attached to a Y-block section 23. The Y-block section 23 has laterally offset first and second passages 24 and 25 at the lower portion thereof and is internally profiled to ensure smooth travel of a cable to the second offset passage 25. The first passage 24 communicates the inner chamber of Y-block section 23 with the outlet of the downhole pump 14 supported from the lower end of said Y-block section 23 . The second passage 25 has a reduced diameter compared to the first one and communicates the inner chamber of Y-block 23 with the well bore. The second passage 25 is designed to receive a cable section 26 passing therethrough in a substantially sealed manner as described thereafter.

The lower end of the downhole pump 14 is attached by means of a supporting bracket 27 to a protecting tubular section 28 designed to receive the well logging tool 15.

The well logging tool may comprise several sensing portions for measuring various characteristics of the fluids flowing around the tool. A well logging tool suitable for such measurements is described in U.S. Pat. No. 4,267,726 which has been mentioned thereabove. For example, the well logging tool may comprise two flowmeters for redundancy, a differential pressure gradient detector, a temperature sensor, a pressure sensor, a gamma ray sensor and a casing collar locator. Electronic circuits housed in the tool are used to supply electric power to the sensors and to process and transmit electrical signals to the surface through a wireline or cable which preferably has a single conductor.

An electrical cable section 26 which may be a pre-cut portion of the same wireline is connected electrically and mechanically to the top of the well logging tool 15 via a cable head 29 and extends upwardly along the pump 15, through the second passage 25 and within the bore of Y-block section 23, the lower latching section 22 and the intermediate tubing section 21.

The cable section 26 has an upper end attached to a support 31 which is releasably held in the upper latching section 20. When released from the upper latching section 20, the support 31 can be moved downwardly within the intermediate tubing section to the lower latching section 22. Also, the support 31 can be releasably latched in lower latching section 22. In order to unlatch, latch and move the support, a wireline (not shown) is run into the tubing string from the surface of the earth, the lower end of the wireline is connected to the support 31 and the wireline is manipulated at the surface as explained thereafter.

Figure 2A:
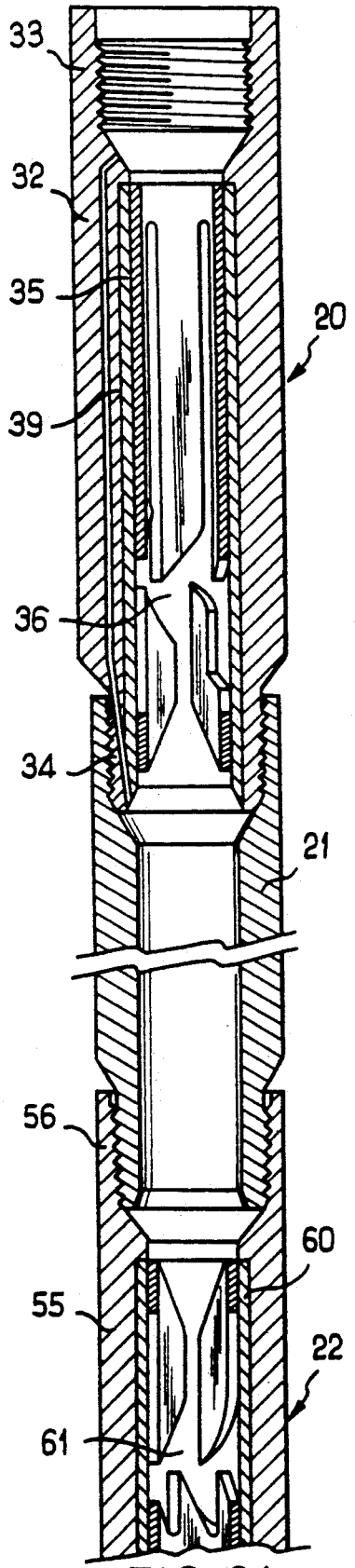
FIGS. 2A–2C are longitudinal sectional views of the apparatus of FIG. 1 in which the well logging assembly is not shown.
Figure 2B:
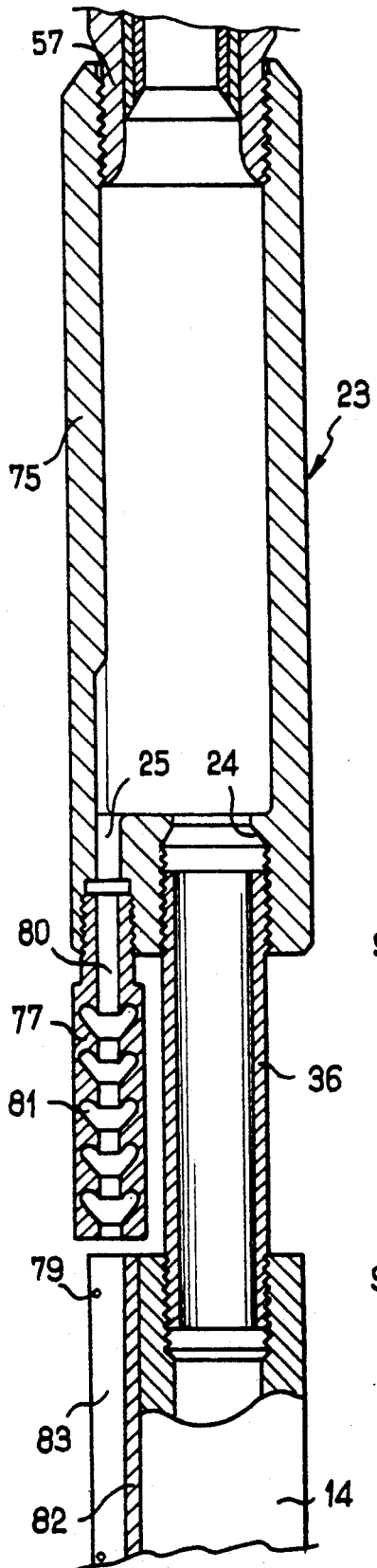
Figure 2C:
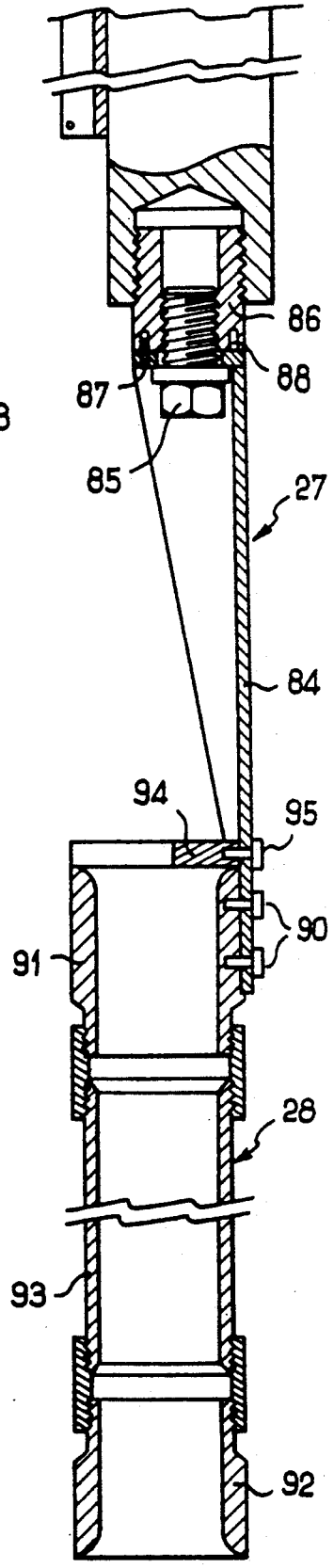

Referring now to FIGS. 2A–2C, the various sections attached to the tubing string 10 are shown without the logging assembly formed by support 31, cable section 26 and logging tool 15. However it will be understood that the logging assembly has to be positioned within these sections before assembling them together and before lowering the tubing string 10 into the well.

The upper latching section 20 includes a tubular body 32 having upper and lower threaded portions 33 and 34 adapted to be threaded to the tubing string 10 and to the intermediate tubing section 21 respectively. A plurality of longitudinal fluid passages 39 regularly distributed around the longitudinal axis, are located within the wall of the body 32 for providing fluid communication between the top and bottom thereof when the support 31 is located within the latching section 20.

Figure 6:
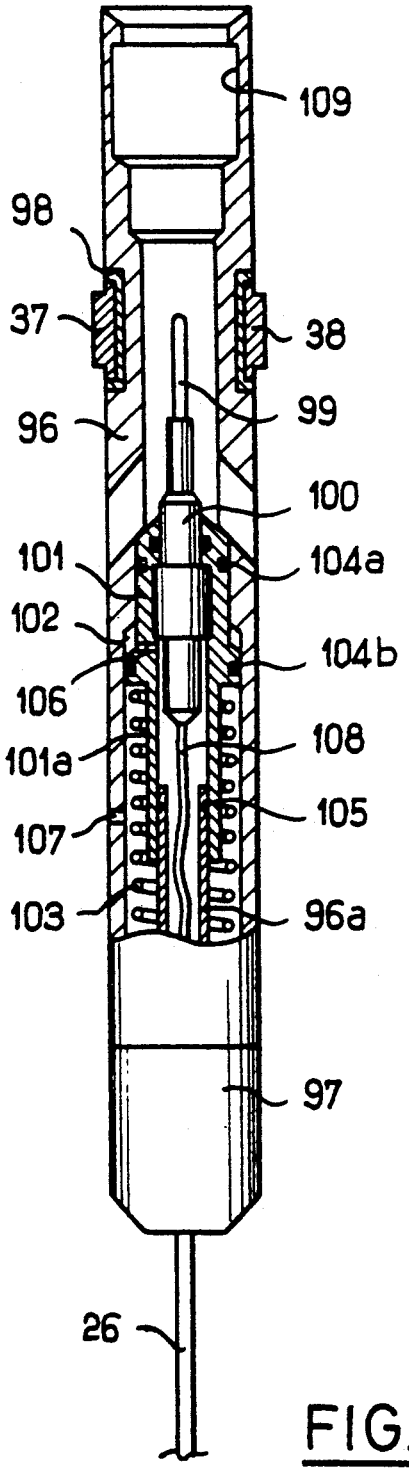

A slotted latching sleeve 35 is fixed within the tubular body 32, the sleeve having an inwardly opening cam slot 36 adapted to receive two diametrically opposed, outwardly extending lugs 37, 38 of the support 31 (see FIG. 6).

Figure 3:
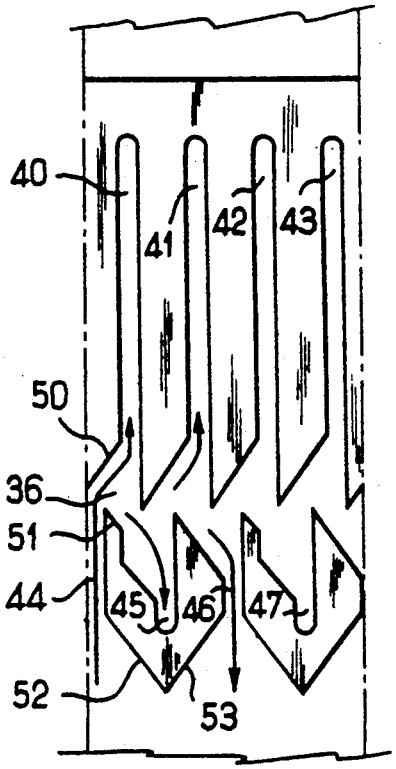
FIGS. 3 and 4 are fold-out views of the upper and lower latch sections of FIG. 2A respectively.

The cam slot 36 has a dual "M" general shape as better shown in FIG. 3 which is a fold-out view of the sleeve 35. This cam slot 36 is formed by four upwardly closed upper longitudinal slots 40–43 and by four angularly offset lower longitudinal slots 44–47, the slots 44 and 46 being open downwardly while slots 45 and 47 are closed downwardly. The cam slot 36 also includes inclined slots having ramp surfaces such as 50 and 51 disposed between the upper and the lower longitudinal slots in a manner such that, when the support 31 is moved upwardly or downwardly within sleeve 35, the lugs 40 and 41 can only move from one longitudinal slot to the next in one rotational direction. Also ramp surfaces 52 and 53 are provided for guiding the lugs 37 and 38 upwardly into the longitudinal slots 44 and 46.

For example, if the support 31 is moved upwardly from a position below the upper latching section 20, the lugs 37 and 38 will be moved upwardly through the longitudinal slots 44 and 46 to the longitudinal slots 40 and 42 until they reach the top thereof. A downward movement of the support 31 will move the lugs to the longitudinal slots 45 and 47 so that the support will be suspended in the upper latching section 20. Another sequential upward and downward movement will release the support 31 from the upper latching section 20. The process may be repeated for exact duplication of events.

Turning back to FIG. 2A, the lower latching section 22 includes a tubular body 55 having upper and lower threaded portions 56 and 57, the upper threaded portion 56 being connected to the lower portion of the intermediate tubing section 21. A slotted latching sleeve 60 is fixed within the tubular body 55 and comprises an inwardly opening cam slot 61 adapted to receive the lugs 37, 38 of the support 31.

Figure 4:
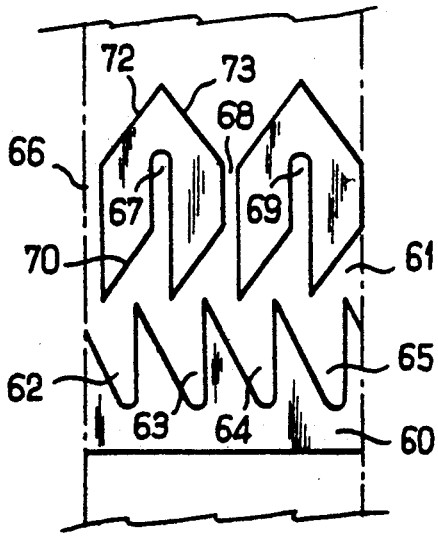

The cam slot 61 has a generally dual "W" shaped configuration as better shown on FIG. 4 which is a fold-out view of the sleeve 60. The cam slot 61 which is somehow symmetrical to the cam slot 36 with respect to an horizontal plane is formed by four downwardly closed lower longitudinal slots 62–65 and by four upper longitudinal slots 66–69 alternately open and closed in an upward direction. Inclined slots having ramp surfaces such as 70 and 71 are disposed between the upper and lower longitudinal slots in order to guide the lugs 37 and 38 from one longitudinal slot to the next in only one rotational direction. Other cam surfaces 72, 73 are provided to guide the lugs 37 and 38 to the longitudinal slots 66 and 68 when the support 31 is moved downwardly into the lower latching section 22.

If the support 31 is lowered into the lower latching section 22, the lugs 37 and 38 come to rest into the longitudinal slots 62 and 64. An upward movement of the support 31 moves the lugs to the upwardly closed slots 67 and 69 where the support is prevented from further upward movement. A further reciprocation of the support 31 releases this support from the lower latching section 22 for upward movement within the intermediate tubing section 21.

The Y-block section 23 is connected to the threaded portion 57 of the lower latching section 22 and includes a tubular housing 75 having the two threaded passages 24 and 25 at the lower end thereof. A tubular connecting member 76 is threaded in the passage 24 and has a lower end connected to the outlet of the electrical downhole pump 14.

A tubular pressure controlling member 77 threaded in the passage 25 has a longitudinal channel 80 which enables the cable section 26 to be directed out of the Y-block section 23 to the side of the pump 14. This pressure controlling member, or flow tube 77, ensures a seal on the cable section 26 to prevent the pump from recirculating on itself while enabling movement of the cable section 26 through the channel 80. The seal is obtained in a known manner by a series of turbulence cavities 81 disposed along the cable channel 80.

The electrical downhole pump 14 is a conventional submersible pump used in oil wells and fed with current from the surface of the earth through a round power electrical cable which is spliced to a flat portion (not shown) attached along the sections 20–23. Cable guides 82 are fixed along the pump 14 and a outwardly opening longitudinal groove 83 is cut along their length for receiving and protecting the logging cable section 26 which is retained therein by removable pins 79.

The supporting bracket 27 comprises an elongated body 84 having an upper portion fixed by a bolt 85 to an adapter sleeve 86 which is threaded at the lower end of the pump 14.

Alignment of the protecting tubular section 28 with the cable guides 82 attached to the side of the pump, can be obtained by slightly unlocking the bolt 85 and correctly orienting the body 84 about the longitudinal axis of the tool. A pin 87 which is driven through the upper portion of the body 84 is located through one of a series of vertical grooves 88 cut in the lower surface of the adapter sleeve 86 and the bolt 85 is locked. The body 84 is attached to the protecting section 28 by screws 90.

The protecting section 28 comprises upper and lower entry subs 91 and 92 and an intermediate portion 93 formed by several lengths of conventional tubing. A disk 94 with a radial slot is attached to the body 84 by a screw 95 at the top of protecting section 28.

As indicated previously with reference to FIG. 1, the logging assembly comprising the support 31, the cable section 26 and the logging tool 15 is positioned within the sections shown on FIGS. 2A-B-C before these sections are connected to one another. The support 31 is best shown on FIG. 6.

Referring to FIG. 6, the support 31 comprises a housing 96 connected to a cable head 97 which supports the logging cable section 26. In the example, the cable section has a single conductor. The previously mentioned diametrically opposed lugs 37 and 38 are outwardly extending portions of a ring which is rotatably mounted on a bushing 98 disposed in an annular groove of the housing 96.

A male electrical contact member 99 of the banana plug type comprises an insulating portion 100 which is fixed to a stepped piston 101 movably mounted in a corresponding stepped portion of the housing 96 defining an annular chamber 102. The piston 101 is biased upwardly by a compressed coil spring 103 and includes a lower tubular portion 101*a* slidably mounted on an upwardly directed sleeve 96*a* attached to the housing 96. The piston 101 is provided with upper and lower "O" ring seals 104*a*, 104*b* outwardly disposed on its smaller and larger portions respectively. Also, a seal 105 is located between the outer surface of the sleeve 96*a* and the inner surface of the lower tubular portion of piston 101.

A radial passage 106 communicates the chamber 102 with the bore of sleeve 96*a* which is filled with air at the atmospheric pressure. A passage 107 communicates the annular space between the housing 96 and the sleeve 96*a* with the borehole fluids. The transverse areas S1, S2 and S3 that are surrounded by seals 104*a*,104*b* and 105 respectively, are designed such that the piston 101 is pressure balanced for varying ambient hydrostatic pressures ($S2-S1=S3$).

The lower portion of the contact member 99 is connected by means of an insulated wire 108 to the single conductor of the cable section 26. The upper portion of the housing 96 has an enlarged diameter region which forms an inner annular groove 109 adapted for mechanical connection with a wireline as explained thereafter.

Figure 5:
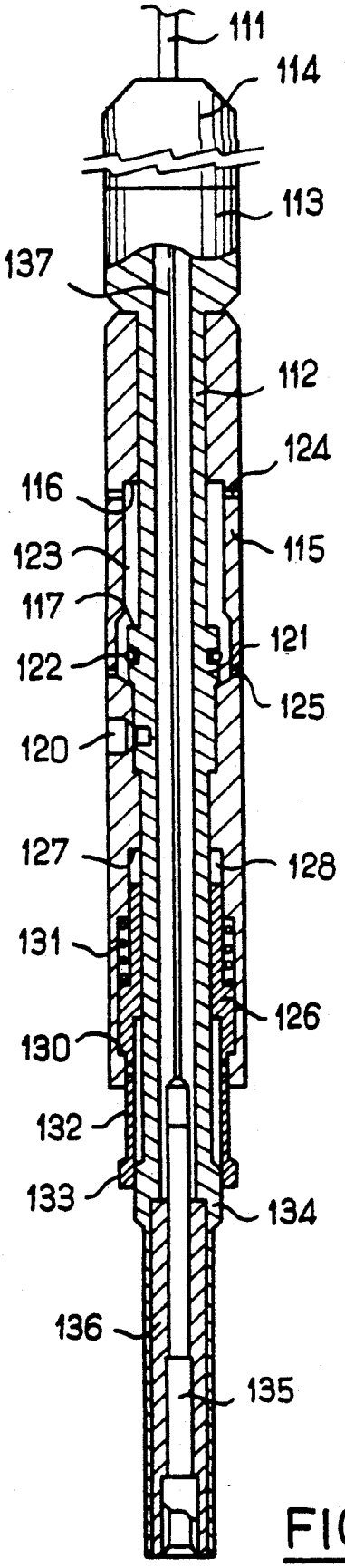
FIGS. 5 and 6 are longitudinal sectional views of female and male connectors used in the apparatus according to the invention.

The support 31 shown on FIG. 6 is the "male" portion of a connector which has a "female" portion 110 shown on FIG. 5. The female connector 110 is attached to the lower end of a wireline 111 to be lowered into the tubing string for mechanical and electrical connection with the support 31.

The female connector 110 comprises an elongated mandrel 112 having an upper portion 113 of larger diameter which is attached to a wireline 111 via a cable head 114. An outer housing 115 is slidably mounted on the mandrel 112 between an upper position where the top of the housing 115 engages the enlarged diameter portion 113 of the mandrel and a lower position where a downwardly directed shoulder 116 of the housing 115 engages an upwardly directed shoulder 117 of the mandrel 112. The outer housing 115 is maintained in the upper position relative to the mandrel 112 by a shear screw 120 which is positioned in an appropriate threaded hole through the wall of housing 115.

In order to dampen the shock of the mandrel 112 when the shear screw 120 is broken by an overpull on wireline 111, the mandrel 112 comprises an enlarged piston 121 on which is located an oversize "O" ring 122. The piston 121 is located within a stepped chamber 123 of the housing 115, the chamber 123 comprising an upper portion having a diameter slightly larger than the diameter of the piston 121 and a lower portion with a substantially larger diameter. Upper and lower openings 124 and 125 through the wall of the housing communicate the chamber 123 with the exterior of the housing 115. When the mandrel moves upwardly with respect to the housing 115, the piston 121 moves from the lower enlarged portion of the chamber 123 to the upper reduced diameter portion, thereby acting as a shock absorber to reduce jarring in the wireline.

Below the shear screw 120, the housing 115 comprises an annular chamber 128 in which a latching sleeve 126 is slidably mounted between an upper position where the top of the sleeve 126 engages a corresponding downwardly facing shoulder 127 of the housing and a lower position where a downwardly facing shoulder of the sleeve 126 engages a upwardly facing shoulder 130 of the housing 115. A coiled spring 131 is compressed between the sleeve 126 and the housing 115 to bias the latching sleeve 126 downwardly.

The lower portion of the latching sleeve 126 comprises a plurality of spaced apart elastic fingers 132 disposed about the periphery of mandrel 112. The lower ends of fingers 132 have outwardly projecting heads 133 which are prevented from collapsing radially by an enlarged portion 134 of the mandrel 112. When the latching sleeve 126 is moved upwardly with respect to the mandrel 112 until the heads 133 reach a position above the enlarged portion 134, the heads 133 can be collapsed by inwardly directed forces since they are not supported any more by the enlarged portion 134. Also, the heads 133 of fingers 132 can be collapsed if the shear screw is broken and if the mandrel 112 is moved upwardly with respect to the housing 115 since the heads 133 then reach a position well below the enlarged portion 134.

A female electrical contact 135 is fixed in the lower portion of the mandrel 112 by means of an insulating sleeve 136 and is designed internally to mate with the male electrical contact 99 of the support 31. The female electrical contact 135 is connected to the single conductor of the wireline 111 via a conductor 137 located in the bore of the mandrel. "O" rings (not shown) are located at suitable locations to prevent fluid entry into the bore of the mandrel 112.

In operation, the female connector 110 is first assembled as shown on FIG. 5 with the shear screw 120 maintaining the housing 115 in the upper position with respect to the mandrel 112.

Then, the female connector is lowered to engage the support 31. When the female connector 110 is moved downwardly, the lower portion of the mandrel 112 is inserted into support 31 with the male contact 99 engaging the female contact 135. The piston 101 then moves down compressing the spring 103. When the heads of the latching fingers 132 engage the top end of the support housing 96, they are stopped during the downward movement of the mandrel 112 until they are not supported any more by the enlarged portion 134.

Then, the heads 133 are collapsed by the bevelled upper surface of the support 31 and penetrate into the housing 96. When the enlarged portion 134 of the mandrel has penetrated into the annular groove 109 by a sufficient amount, the heads of the latching fingers 132 are able to snap into the annular groove under action of the spring 131.

Applying tension to the assembly via the wireline lifts the enlarged portion of the mandrel 112 to a position behind the latching finger heads 133, hence locking them in the groove 109 where they are maintained by the enlarged portion 134 of the mandrel 112. At this time, the female connector 110 is mechanically and electrically connected to the support 31. The piston 101 does not return to its upper position stopping slightly below and applying an upwardly directed force to the electrical contact 99 under the action of spring 103.

In order to release the female connector 110 from the support 31, a predetermined overpull (for example 500 kg) is applied to wireline 111 to break the shear screw 120. When this screw is broken, the mandrel 112 can be pulled up with respect to the housing 115 until the enlarged portion 134 does not support the latch fingers 132 any more. At this time, the heads 133 of the fingers collapse inwardly and release the support 31.

Figure 7A:
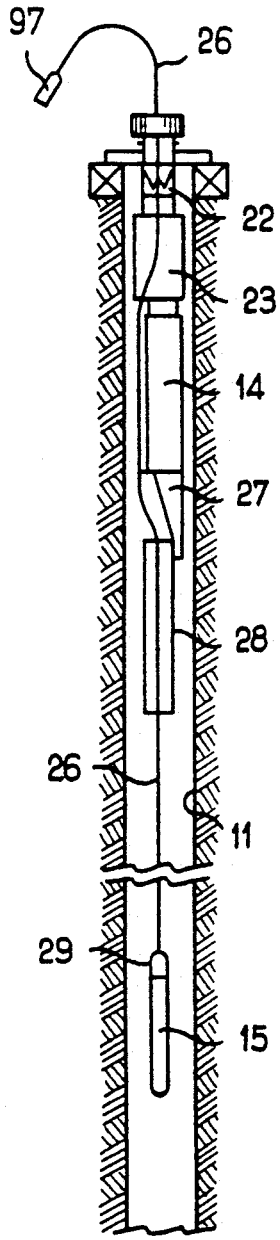
FIGS. 7A–7D are schematic views which illustrate several positions of the apparatus in accordance with the invention during an operation in a well.

The method of the invention will now be described with reference to FIGS. 7A to 7C.

When a production logging operation is to be conducted in well 11, the lower latching section 22, the Y-block section 23 and the downhole pump 14 are first assembled together and a piece of cable 26 of sufficient length is threaded through the flow tube 77, the Y-block 23 and the lower latching section 22. The heads 29 and 97 are made up at the ends of cable 26 and this assembly is suspended above the well head.

Then, the protecting tubular section 28 is hung in the well head. The production logging tool 15 is inserted into the protecting section 28 and maintained by appropriate clamps therein. The lower head 29 of the cable section 26 is connected to production logging tool 15 and the supporting bracket 27 at the bottom of pump 14 is attached to protecting section 28. The whole assembly is lowered into the well and the cable section 26 is clamped above the lower latching section as shown on FIG. 7A.

Figure 7B:
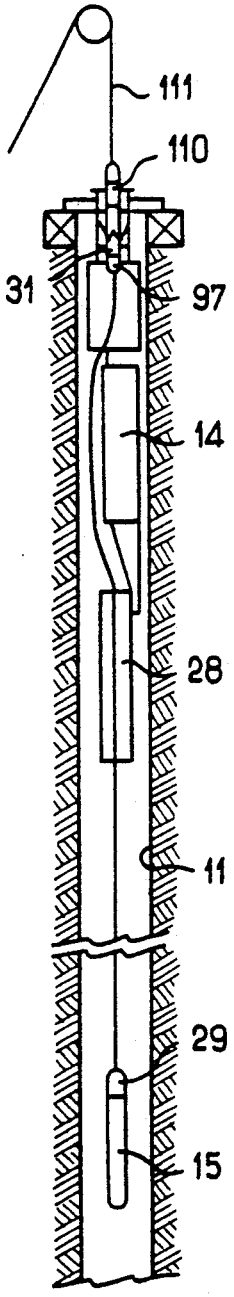
Figure 7C:
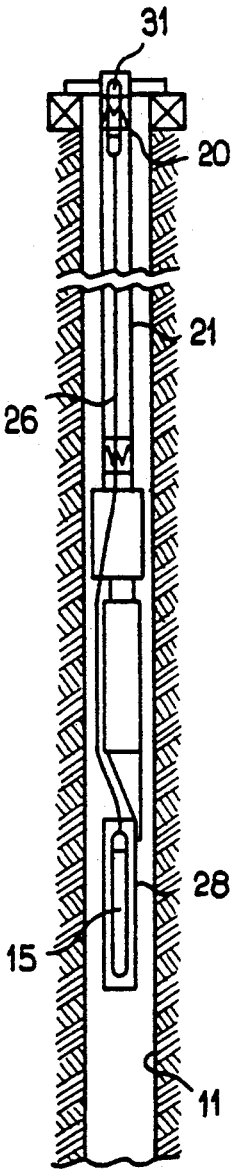

At this time, the wireline can be mated with the cable section 26 and the functions of the logging tool and of the connector can be checked as shown on FIG. 7B. It will be appreciated that the logging tool can be checked out of the protecting section 28 and that a complete connecting and latch cycle can be performed in the lower latching section 22.

The cable head 97 is connected to the wireline 111 via the support 31 and the female connector 110, and the cable clamp is disconnected. Usual winch and sheaves are used to lower the logging tool until the support 31 rests in the lower latching section 22. This position is shown on FIG. 7B.

After checking the functions of the apparatus, the female connector 110 is disconnected from the support 31 by unscrewing the shear screw 120. Then, the bottom hole assembly, with the support 31 in the lower latching section 22, is run into the well by adding a number of tubing lengths on top of this section 22. The length of the intermediate tubing section must be greater than the length of the logging interval i.e. generally more than several hundred feet.

The upper latching section 20 is attached to the top of the intermediate tubing section 21. Then by connecting again the female connector 110 to support 31 and pulling on the wireline 111, the support 31 is lifted to the upper latching section 20. An overpull on the wireline disconnects the female connector 110 from support 31 while leaving this support suspended in the M shaped slots of the upper latching section 20. At this time, the downhole apparatus is in the position shown on FIG. 7C with the well logging tool 15 in the protecting tubular section 28.

The downhole apparatus is lowered into the well 11 to a predetermined position slightly above the formation interval 12 as indicated on FIG. 1.

Figure 7D:
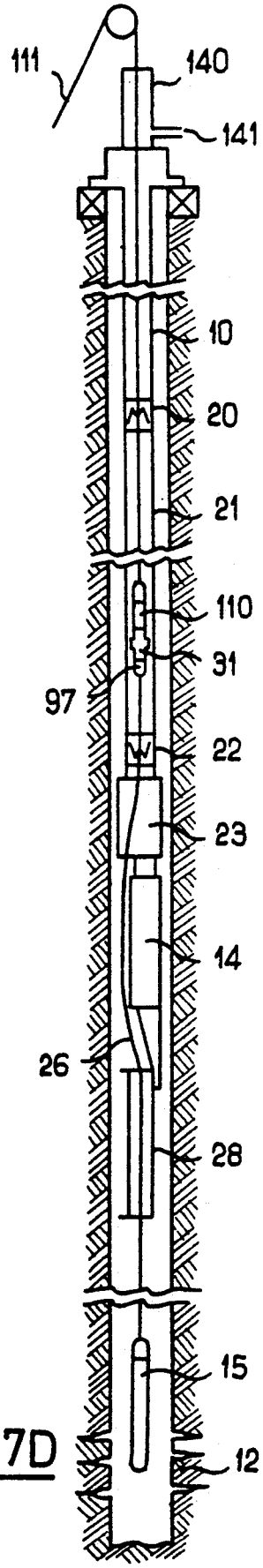

When the tubing string is in this predetermined position, a pressure control equipment 140 schematically shown on FIG. 7D is installed at the top of the tubing string, this equipment having an outlet 141. Then, the female connector 110 is lowered into the tubing with the wireline 111 passing through the pressure control equipment.

The female connector 110 is connected to support 31 in the upper latching section 20 then the support 31 is released from the upper latching section 20. The electrical downhole pump 14 is operated so that fluids flow from the formation interval 12. When a stable flow is reached, the production logging tool 15 is lowered to the formation interval where logging measurements are taken as a function of depth and transmitted to the surface of the earth via the wireline 111. Generally several logging passes are run while pumping and after shutting down the pump.

After logging, the support 31 is lowered into the lower latching section 22 and the female connector 110 is disconnected from the support 31 by applying an overpull on the wireline 111. The wireline and the female connector are pulled out of the well and the logging tool 15, the cable 26 and the support 31 are left downhole with the support 31 being positioned in the lower latching section 22 and the logging tool being suspended from the cable section 26 well below the protecting section 28.

The tubing string with the downhole apparatus including the logging assembly suspended therefrom is then pulled out of the well. This operation is easy since the wireline 111 has been removed from the tubing string. It will be recognized that the whole tubing string 10, the upper latching section 20 and the intermediate tubing portion 21 can be dismounted since support 31 is located within the lower latching section 22.

Accordingly, a new method for logging a formation interval below a downhole submersible pump has been provided in which a pump and a logging assembly can be simultaneously operated for determining characteristics of the fluids pumped from the formation interval. Usual submersible pumps and logging tools can be used in casings with diameters as small as 7". The apparatus has been designed to be easily operated by the rig floor operator as well as by the well logging operator.

Changes may be made in the disclosed embodiment without departing from the inventive concept involved as covered in the appended claims.

We claim:

1. A method for evaluating the fluids produced by pumping from a formation interval in a well, comprising the steps of:

lowering into the well a tubing carrying a downhole pump and a logging assembly, said logging assembly comprising a support slidably mounted in the tubing between an upper and a lower position above the pump, a cable section attached to the support and passing from the bore of the tubing to the well bore along the pump through a sealed passage, and a well logging tool attached at the lower portion of the cable section;

passing a cable from the surface through the tubing;

connecting the cable to the support; and lowering the support in the tubing for bringing the logging tool to the formation interval to evaluate the fluids produced from the formation interval by the downhole pump.

2. A method according to claim 1 comprising the step of locating the logging tool within protecting means attached to the pump before lowering the downhole pump and the logging assembly into the well.

3. A method according to claim 2 further comprising the steps of:

deconnecting the cable from the support;

pulling the cable out of the tubing; and withdrawing the pump and the logging assembly from the well by means of the tubing.

4. A method according to claim 3 further comprising the step of latching the support at the lower position in the tubing before deconnecting the cable from the support.

5. A method for evaluating the fluids produced by pumping from a formation interval in a well, comprising the steps of:

assembling, at the surface of the earth, a length of tubing carrying a downhole pump and a logging assembly, said logging assembly comprising a support slidably mounted in the tubing between an upper and a lower position above the pump, a cable section attached to the support and passing from the bore of the tubing to the well bore along the pump through a sealed passage, and a well logging tool attached at the lower portion of the cable section;

lowering the length of tubing, the pump and the logging assembly into the well with the support being latched at said upper position in the length of tubing;

passing a cable from the surface through the tubing;

connecting the cable to the support; and manipulating the cable at the surface, after connection to the support, for releasing the support from the upper position to bring the logging tool to the formation interval to evaluate the fluids produced from the formation interval by the downhole pump.

6. A method according to claim 5 comprising the step of locating the logging tool within protecting means attached to the pump before lowering the downhole pump and the logging assembly into the well.

7. A method according to claim 5 further comprising the steps of:

deconnecting the cable from the support;

pulling the cable out of the tubing; and withdrawing the length of tubing, the pump and the logging assembly from the well.

8. A method according to claim 5 further comprising the steps of:

latching the support at the lower position in the tubing after evaluating the fluids produced from the formation interval;

deconnecting the cable from the support;

pulling the cable out of the tubing; and withdrawing the length of tubing, the pump and the logging assembly from the well.

9. An apparatus for evaluating the fluids produced by pumping from a formation interval in a well, comprising:

a pump connected to a tubing suspended in the well;

a mounting block located above the pump and having a passage communicating the bore of the tubing with the well bore along the pump;

a support slidably mounted in the tubing between an upper and a lower position above the mounting block;

a cable section attached to the support and passing from the bore of the tubing through the passage to the well bore along the pump;

a well logging tool attached to the cable section below the pump;

sealing means in the passage for substantially preventing fluid from being pumped through the passage around the cable section; and first connecting means on the support engageable by second connecting means at the end of an electrical cable extending to the surface for mechanically and electrically connecting the cable to the support to move the logging tool to the formation interval to evaluate fluids produced from the formation interval by the pump.

10. An apparatus according to claim 9 further comprising upper latching means for releasably maintaining said support in the upper position in the tubing.

11. An apparatus according to claim 10 wherein said upper latching means comprises slot means engageable by lug means on said support said slot means comprising longitudinal slots that are connected together by inclined slots in a manner such that, as said support is moved upwardly and downwardly within said latching means, said lug means is rotated in only one rotational direction, said longitudinal slots including at least one downwardly closed slot for maintaining said support in said upper position and at least one downwardly opened slot for releasing said support from said upper position.

12. An apparatus according to claim 11 wherein said longitudinal slots include at least one upwardly closed slot for preventing said support from upward movement when said lug means is located in said upwardly closed slot in order to disconnect said second connecting means from said first connecting means when a tension is applied to said electrical cable.

13. An apparatus according to claim 10 further comprising protecting means attached below said pump for receiving the well logging tool when the support is in the upper position.

14. An apparatus according to claim 10 wherein said upper latching means comprise a body having longitudinal fluid passage means therethrough for providing fluid communication between the upper and lower portions of said body.

15. An apparatus according to claim 9 further comprising lower latching means for releasably maintaining the support in the lower position in the tubing.

16. An apparatus according to claim 15 wherein said lower latching means comprises slot means engageable by lug means on said support said slot means comprising longitudinal slots that are connected together by inclined slots in a manner such that, as said support is moved upwardly and downwardly within said lower latching means, said lug means is rotated in only one rotational direction, said longitudinal slots including at least one upwardly opened slot for upwardly releasing said support from said lower position and at least one upwardly closed slot for preventing upward movement of said lug means in order to disconnect said second connecting means from said first connecting means when a tension is applied to said electrical cable.

17. An apparatus according to claim 9 wherein said sealing means comprises a tubular member mounted in said passage around said cable section said tubular member having a series of longitudinally spaced turbulence chambers for providing a series of pressure drops along said tubular member around said cable section while enabling movement of said cable section in said tubular member.

* * * * *